United States Patent [19]

Frei

[11] 4,190,104

[45] Feb. 26, 1980

[54] HEAT EXCHANGER HAVING HELICALLY WOUND TUBE COILS

[75] Inventor: Arno Frei, Seuzach, Switzerland

[73] Assignee: Sulzer Brothers Limited, Winterthur, Switzerland

[21] Appl. No.: 850,195

[22] Filed: Nov. 10, 1977

[30] Foreign Application Priority Data

Nov. 17, 1976 [CH] Switzerland ..... 14442/76

[51] Int. Cl.[2] ..... F28D 7/02; F22B 37/24

[52] U.S. Cl. ..... 165/162; 165/163; 122/510

[58] Field of Search ..... 165/162, 82, 163, 156; 122/510

[56] References Cited

U.S. PATENT DOCUMENTS

| | | | |
|---|---|---|---|
| 2,228,953 | 1/1941 | Hackett | 122/510 |
| 3,286,767 | 11/1966 | Evans | 165/82 |
| 3,545,534 | 12/1970 | Coles | 165/162 |
| 3,677,339 | 7/1972 | Perrin et al. | 165/162 |
| 3,742,567 | 7/1973 | Kaelin | 165/162 |
| 4,088,184 | 5/1978 | Cavallaro | 165/162 |

*Primary Examiner*—Charles J. Myhre
*Assistant Examiner*—M Moy
*Attorney, Agent, or Firm*—Kenyon & Kenyon

[57] ABSTRACT

The heat exchanger is constructed with an axial guide such that the tube bunch can move axially within a cylindrical jacket in order to compensate for vibrations due, for example, to horizontal earthquake waves. Shoes are secured to the support plates to the tube coils and are slideably mounted within elongated slots in the jacket or vice versa. Should a vertical motion occur, the shoes are able to slide within the slots while the tube coils and their support plates remain supported within the jacket.

14 Claims, 6 Drawing Figures

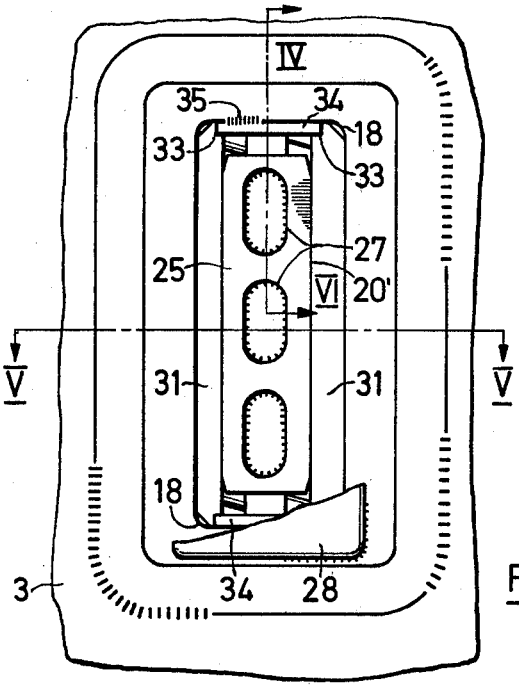
FIG. 4
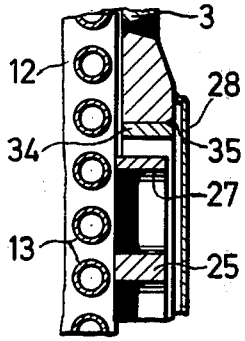
FIG. 6
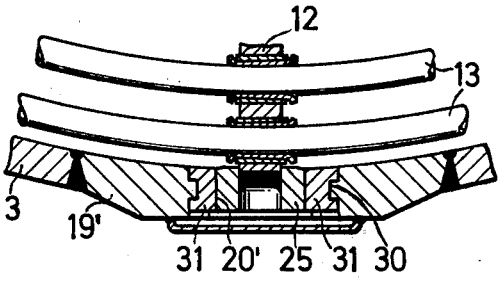
FIG. 5
FIG. 2
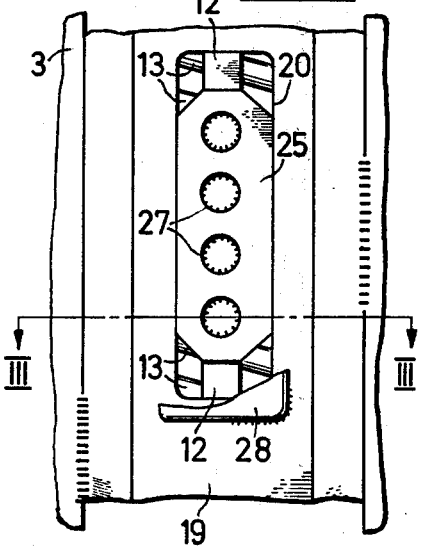
FIG. 3
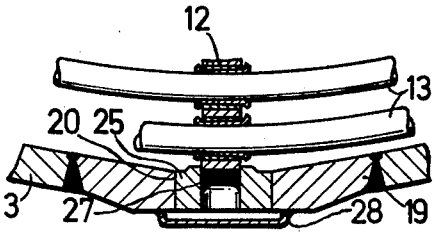

HEAT EXCHANGER HAVING HELICALLY WOUND TUBE COILS

This invention relates to a heat exchanger. More particularly, this invention relates to a heat exchanger having a plurality of helically wound tube coils. Still more particularlly, this invention relates to a mounting arrangement for helically wound tube coils of a heat exchanger.

As is known, heat exchangers have been constructed with a bunch of helically wound tube coils which are disposed in concentric relation to each other and which are mounted in vertical disposition. In some cases, these tube coils have been supported in at least three support bearing plates which are distributed over the periphery of the tube bunch in a substantially radial manner. In addition, a cylindrical jacket generally surrounds the tube coils.

In some cases, it is required that these heat exchangers be provided with a transverse support for the support plates in order to deal with stresses arising, for example, in the event of earthquakes. Further, it has been essential to allow for unimpeded heat expansion axially of the heat exchanger. As is known, during an earthquake, horizontal vibrations may occur in the earth and, therefore, in such heat exchangers.

Accordingly, it is an object of the invention to provide a transverse support for the tube coils of a heat exchanger.

It is another object of the invention to permit a heat exchanger constructed with helically disposed tube coils to react to a heat expansion axially of the exchanger in an unimpeded manner.

It is another object of the invention to provide a simple means for providing an axial guide for a tube coil within a cylindrical jacket of a heat exchanger.

Briefly, the invention provides a heat exchanger which is comprised of a plurality of radially oriented and vertically disposed support plates, a plurality of helically wound tube coils mounted in the support plates in concentric relation to each other and a vertically disposed cylindrical jacket peripherally disposed about the support plates and tubes. In accordance with the invention, this heat exchanger is provided with at least one shoe which is mounted on one of the support plates and the cylinder as well as with at least one slot which is disposed in the other of the support plates and cylinder. The slot is disposed to receive the shoe and is of an axial length which is longer than the axial length of the shoe to permit axial movement of the support plates relative to the cylinder.

The support arrangement provided by the shoes and slots effects a simple axial guide for the tube coils within the cylindrical jacket. In the event of a horizontal earthquake wave, the axial guide insures that the vibrations of the tubes of the tube coils remain within predetermined limits. Further, by providing the guide slots in the jacket or in the edges of the support plates and by using a shoe, the axial guide takes up very little space. The axial guide is therefore useful for heat exchangers in which the tube coils are very close together and in which there is only a small gap between the jacket and the outermost tube coil. Also, the use of a shoe allows the guide to be machined economically and accurately at the site where the heat exchanger is to be assembled.

In one embodiment of the invention, the cylindrical jacket can be provided with a plurality of wall elements with each element having one of the slots form therein. This simplifies production and assembly of the axial guide since only the relatively small wall elements require machining rather than the bulky cylindrical jacket which is otherwise difficult to handle. Further, the wall elements require only a simple welding in order to be secured in the jacket.

In still another embodiment, a pair of parallel axially extending ledges can be disposed in each wall element on opposite sides of the slot. Such ledges can be of channel shaped cross-section to engage about the wall element and can be pressed against the jacket by a pair of wedges which are located between each pair of ledges.

In still another embodiment, a metal hood is secured to the jacket in gas-tight manner over each slot. Each hood can be secured in place after the securement of the shoes in place. To this end, each shoe is provided with transverse apertures which extend therethrough to permit welding of a respective support plate thereto.

In order to insure slidability even at high temperatures, the respective sliding surfaces of the shoes and slots can be provided with a coating, for example of chromium carbide. In the case where wall elements or ledges are utilized, the coating can be placed on these easier-to handle wall elements and ledges rather than on the jacket.

Finally, the support for supporting the support plates and tube coils on the jacket may include a plurality of radial arms mounted on the jacket and a plurality of links which are pivotally secured to and between the support plates and radial arms.

These and other objects and advantages of the invention will become more apparent from the following detailed description and accompanying drawings in which:

FIG. 2 illustrates a view of an axial guide between the jacket and support plate of the heat exchanger of FIG. 1;

FIG. 3 illustrates a view taken on line III—III of FIG. 2;

FIG. 4 illustrates a modified construction of an axial guide in accordance with the invention;

FIG. 5 illustrates a view taken on line V—V of FIG. 4;

FIG. 6 illustrates a view taken on line VI—VI of FIG. 4.

Figure 1:
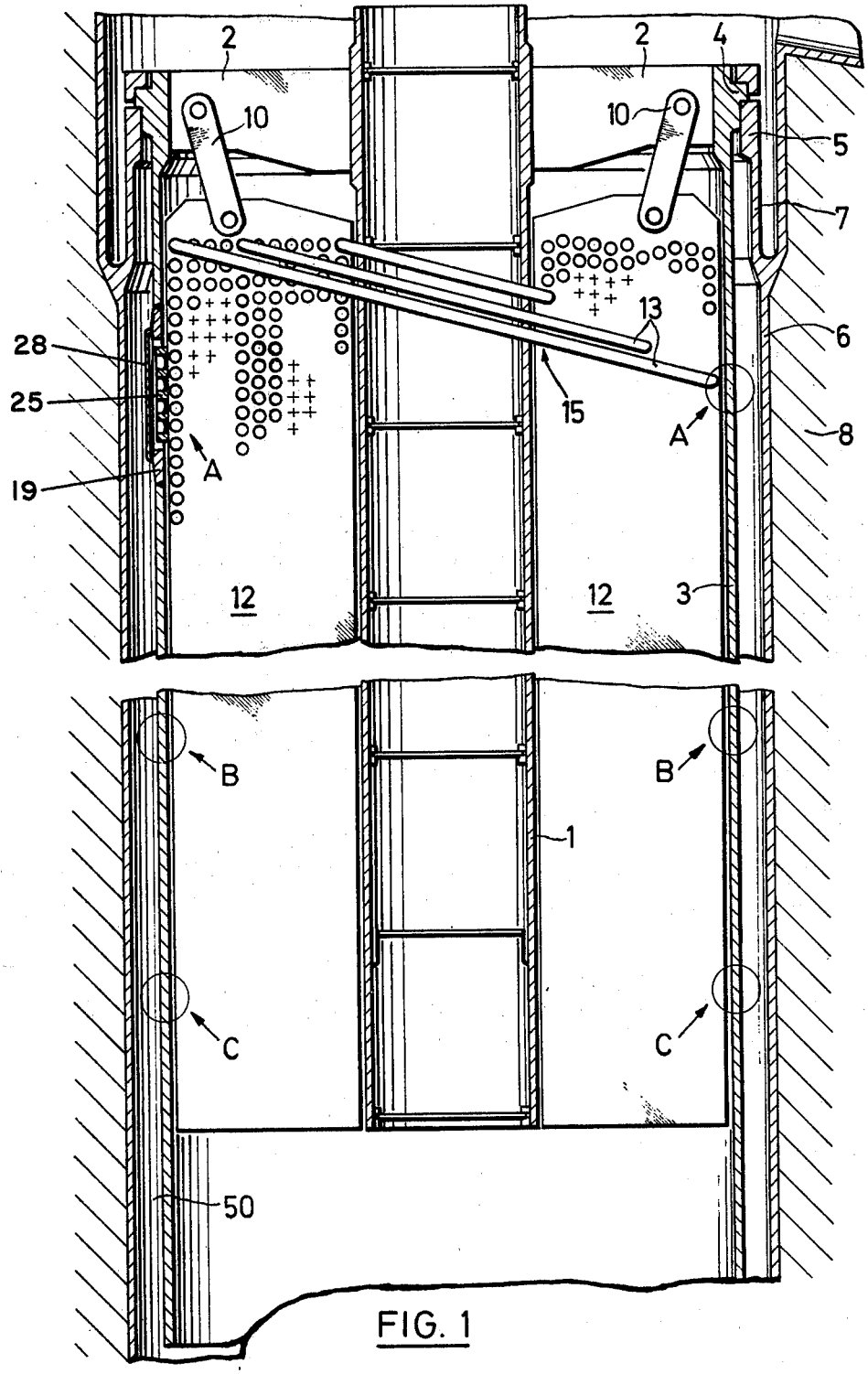
FIG. 1 illustrates a diagramatic view in vertical section through a heat exchanger according to the invention.

Referring to FIG. 1, the heat exchanger mainly is constructed of a central cylindrical displacement member 1, a bunch 15 of helically wound tube coils 13, a cylindrical jacket 3 and four support or bearing plates 12 which receive the tubes 13 (only two of the plates are shown in FIG. 1). The heat exchanger is disposed in a passage 50 in which, for example, a gaseous heat-yielding agent flows, which is surrounded by a concrete shield 8 and which communicates with a nuclear reactor. The passage 50 is lined with a lining plate 6 which has an annular extension 7 near the top end of the heat exchanger which merges into an inwardly directed flange 5. The flange 5, in turn, supports an outer flange 4 on the heat exchanger jacket 3.

The heat exchanger also includes a support for supporting the plates 12 on the jacket 3. As shown in FIG. 1, the support includes a plurality of radial arms 2 which are mounted on the jacket 3 and a plurality of links 10 which are pivotally secured to and between the support plates 12 and the radial arms 2. As indicated, a pair of links 10 are used to support each support plate 12 from a respective arm tube.

The support plates 12 are radially oriented and vertically disposed within the jacket 3 while the tube coils 13 are mounted in the support plates 12 in concentric relation to each other. Likewise, the jacket 3 is vertically disposed and is peripherally disposed about the support plates 12 and tubes 13.

In order to axially guide the tube bunch 15 in the jacket 3 each plate 12 is guided over a relatively short axial length at three places A,B,C distributed over the length of the jacket 3. To this end, as shown in FIGS. 2 and 3, a wall element 19 formed with an axial guide slot 20 is welded into an aperture in the jacket 3 near each support plate 12. Each wall element 19 is of the same thickness as the jacket 3 at the edge where the wall element 19 is welded to the jacket 3 and thickens towards the slot 20. In addition, a shoe 25 is disposed within the slot 20 in a slidable relation and is secured to a support plate 12. As shown, the axial length of the slot 20 is longer than the axial length of the shoe 25 to permit axial movement of the support plates 12 relative to the jacket 3. The shoe 25 is secured to the plate 12 by way of transverse apertures 27 which extend through the shoe 25 towards the plate 12 so as to permit welding of the support plate 12 to the shoe 25. In order to prevent any flow of the heat-yielding medium through the slot 20 a metal hood 28 is secured to the jacket 3 in a gas-tight manner over each slot 20. The hood 28 is made of a flat thin metal and is shallow or flat enough for the jacket 3 to be moved through the flange 5 of the lining 6.

It is likely that when the tubes 13 are screwed into the plates 12, these plates are not arranged exactly in two meridian planes perpendicular to one another and that they are offset from the slots 20. In this case, the shoes 25 can be disposed asymmetrically to accommodate the offset of the plates 12. Consequently, the heat exchanger can be assembled free from strain and, when the shoes 25 move axially in the slots 20 in operation, friction remains low.

Referring to FIGS. 4 to 6, the axial guide for the support plates 12 can be alternatively constructed. To this end, the guide includes a wall element 19′ welded into an aperture of the jacket 3 near a support plate 12. This wall element 19′ is formed with a slot-like aperture 18 but does not itself form the boundry of the guide slot 20′. Instead, a pair of parallel axially extending ledges 31 are disposed in each wall element 19′ on opposite sides of the slot-like aperture 18. As shown in FIG. 5, each ledge 31 is of channel-shaped cross-section to engage about the edges 30 of the wall elements 19′. Thus, the facing web surfaces of the ledges 31 bound the axial guide slot 20′ into which the shoe 25 extends. As above, the shoe 25 can be welded to the edge of the plate 12. In order to locate the ledges 31 in the slot-like aperture 18 during assembly of the heat exchanger, a pair of wedges 34 is located between each pair of ledges 31 in order to press the ledges 31 against the wall element 19′. As shown in FIG. 4, the wedges 34 are provided at the top end and at the bottom end of the aperture 18 and abut the ledges 31 via wedge surfaces. These wedges 34 are also formed at the ends with corresponding rebates or the like 33. After the wedges 34 have been introduced, they are secured to the wall element 19′ by means of a stitching seam 35.

In an alternate structure, the jacket may also be constructed so as to receive the pressure of the medium flowing around the tube bunch 15. In this case, the heat exchanger is not placed inside a reactor shield.

In the various embodiments described above, the support plates 12 are guided by the shoes 25 in the axial slots 20, 20′ in the cylindrical jacket 3. However, the converse arrangement is also possible. In this case, the edge of each plate 12 which is adjacent to the cylindrical jacket 3 is formed with an axial slot, for example, by the welding on of an axially extending angle member. Further, the shoe is secured in the jacket 3, for example, after being introduced radially in the slot through an aperture in the cylindrical jacket 3. This feature is particularly useful in cases where the tube bunch 15 is axially subdivided into a number of sections or portions with horizontal gaps therebetween. It is thus possible for the guide slots in the support plates to be disposed in the gap between two adjacent portions of the tube bunch 15.

As an alternative to the embodiment shown in FIGS. 4 to 6, the ledges 31 can be disposed directly in an aperture in the jacket 3.

When a very high temperature heat-yielding gaseous agent flows around the tube bunch 15, the support plates 12 in the jacket 3 may become red-hot. In this event, and particularly in the case of an inert heating gas, the sliding properties of the sliding surfaces of the shoes 25 and the guide slots 20, 20′ may become so impaired that there is a local welding-together of the surfaces. In order to inhibit this, the sliding surfaces can be provided with a coating or covering to prevent the welding together. For example, a coating or covering of chromium carbide can be applied to the sliding surfaces of either or both of the shoes 25 and slots 20, 20′. In the embodiment of FIGS. 4 to 6, it may be sufficient if just the web surfaces of the ledges 31 which bound the slot 20′ have such a coating whereas in the embodiment in FIGS. 2 and 3, the sliding surfaces of the shoe 25 need only be provided with the coating.

What is claimed is:

1. A heat exchanger comprising
   - a plurality of radially oriented and vertically disposed support plates;
   - a plurality of helically wound tube coils mounted in said support plates in concentric relation to each other;
   - a vertically disposed cylindrical jacket peripherally disposed about said support plates and said tubes;
   - at least one slot disposed in said jacket near each of said plates; and
   - at least one shoe mounted on each of said plates each of said shoes being guided in one of said slots, said slot having an axial length longer than the axial length of said shoe to permit axial movement of said support plates relative to said jacket.

2. A heat exchanger as set forth in claim 1 which comprises at least one shoe secured to each of said plates, and a plurality of slots in said jacket respectively receiving said shoes.

3. A heat exchanger as set forth in claim 2 which further comprises a plurality of wall elements welded into said jacket, each said wall element having a respective one of said slots formed therein.

4. A heat exchanger as set forth in claim 3 which further comprises a pair of parallel axially extending ledges disposed in each wall element on opposite sides of said slot therein.

5. A heat exchanger as set forth in claim 4 wherein each ledge is of channel-shaped cross-section to engage about said wall element.

6. A heat exchanger as set forth in claim 5 which further comprises a pair of wedges located between each pair of ledges to press said ledges against said wall element.

7. A heat exchanger as set forth in claim 3 which further comprise a pair of parallel axially extending ledges disposed in said jacket on opposite sides of each slot.

8. A heat exchanger as set forth in claim 1 wherein each shoe has transverse apertures extending therethrough to permit welding of a respective support plate thereto.

9. A heat exchanger as set forth in claim 1 which further comprises a metal hood secured to said jacket in gas-tight manner over each slot.

10. A heat exchanger as set forth in claim 1 wherein said shoe and said slot having respective sliding surfaces thereon and which further comprises a coating on said sliding surfaces of at least one of said shoe and said slot for ensuring a relative sliding movement at high temperatures.

11. A heat exchanger as set forth in claim 10 wherein said coating is made of chromium carbide.

12. A heat exchanger as set forth in claim 1 which further comprises a support for supporting said plates on said jacket, said support including a plurality of radial arms mounted on said jacket and a plurality of links pivotally secured to and between said support plates and said radial arms.

13. A heat exchanger as set forth in claim 1 which further comprises a hollow displacement element mounted centrally of said support plates.

14. A heat exchanger comprising a plurality of radially oriented and vertically disposed support plates;

a plurality of helically wound tube coils mounted in said support plates in concentric relation to each other;

a vertically disposed cylindrical jacket peripherally disposed about said support plates and said tubes;

at least one slot disposed in each said plate near said jacket; and a plurality of shoes mounted in said jacket, each said shoe being guided in a respective one of said slots, each said slot having an axial length longer than the axial length of said shoe to permit axial movement of said support plates relative to said jacket.

* * * * *